US007789700B2

(12) United States Patent
Wang et al.

(10) Patent No.: US 7,789,700 B2
(45) Date of Patent: Sep. 7, 2010

(54) CABLE CONNECTOR WITH A FLAT CABLE AND A PRINTED CIRCUIT BOARD

(75) Inventors: Chien Chun Wang, Taoyuan County (TW); Chih-Fan Wu, Taoyuan County (TW)

(73) Assignee: P-Two Industries Inc., Taoyuan County (TW)

( * ) Notice: Subject to any disclaimer, the term of this patent is extended or adjusted under 35 U.S.C. 154(b) by 0 days.

(21) Appl. No.: 12/511,055

(22) Filed: Jul. 28, 2009

(65) Prior Publication Data

US 2010/0062636 A1 Mar. 11, 2010

Related U.S. Application Data

(63) Continuation-in-part of application No. 12/209,180, filed on Sep. 11, 2008, now abandoned.

(51) Int. Cl.
*H01R 31/08* (2006.01)

(52) U.S. Cl. ..... 439/507

(58) Field of Classification Search ..... 439/507, 439/492, 493, 495, 59, 62, 67
See application file for complete search history.

(56) References Cited

U.S. PATENT DOCUMENTS

| | | | | | |
|---|---|---|---|---|---|
| 3,701,078 | A * | 10/1972 | Lynch | 439/329 |
| 4,416,496 | A * | 11/1983 | Brefka | 439/59 |
| 4,770,645 | A * | 9/1988 | Antes | 439/329 |
| 5,397,247 | A * | 3/1995 | Aoki et al. | 439/496 |
| 2009/0264011 | A1 * | 10/2009 | Wang | 439/507 |
| 2009/0298327 | A1 * | 12/2009 | Wang et al. | 439/507 |
| 2009/0298328 | A1 * | 12/2009 | Wang et al. | 439/507 |

* cited by examiner

*Primary Examiner*—Chandrika Prasad

(57) ABSTRACT

A cable connector includes a flat cable having a plurality of first electric conductive sections formed on a first end and a plurality of second electric conductive sections formed on a second end thereof. A circuit board is electrically connected to the first end of the flat cable. The circuit board has a plurality of first conductive sections and a plurality of second conductive sections respectively formed thereon. The plurality of first conductive sections is electrically connected to the plurality of first electric conductive sections of the flat cable. The plurality of first conductive sections and the plurality of second conductive sections are electrically connected to each other via a displacement circuit disposed in the circuit board.

5 Claims, 3 Drawing Sheets

CABLE CONNECTOR WITH A FLAT CABLE AND A PRINTED CIRCUIT BOARD

CROSS-REFERENCE TO RELATED APPLICATION

This application is a Continuation-In-Part application of Ser. No. 12/209,180, filed 11 Sep. 2008, and entitled "CONNECTING MODULE", now pending.

BACKGROUND OF THE INVENTION

1. Field of the Invention

The present invention relates to a cable connector, and more particularly to a cable connector having a circuit board for providing function as jumper(s).

2. Description of Related Art

As well known, connectors are used as a medium for relatively transmitting signal between/among electric equipments. A conventional connector has two joints disposed to two opposite ends thereof or has one end electrically connected to a circuit board and the other end having a joint mounted thereon relative to the operational condition. However, some conventional connectors need to have a structure to provide a function as jumper(s).

Conventional connecting devices usually include a flat cable electrically connected to a connector in which a series of lead pins is disposed. Each lead pin protrudes out of the connector to form a connecting end. However, the series of lead pins simply provides a function of transmitting signal without concerning the function as jumpers. Consequently, the some wires in the flat cable need to be displaced when the connecting device needs to use the function as jumpers for being suitable to different interfaces.

As a result, the previously displaced flat cable is only provided to connect unique electric equipment such that the user needs to prepare multiple connecting devices with different displaced flat cable for various electric equipments. Consequently, the use scope of the conventional connecting device is limited. In addition, the bad rate of manufacturing the conventional connecting device is raised. The conventional connecting device without jumper function needs to be advantageously altered.

The present invention has arisen to mitigate and/or obviate the disadvantages of the conventional connecting device that has no function concerning jumper.

SUMMARY OF THE INVENTION

The main objective of the present invention is to provide an improved cable connector having a circuit board for providing function as jumper(s).

To achieve the objective, the cable connector in accordance with the present invention comprises a flat cable having a plurality of first electric conductive sections formed on a first end and a plurality of second electric conductive sections formed on a second end thereof. A circuit board is electrically connected to the first end of the flat cable. In preferred embodiment of the present invention, the circuit board is a flexible printed circuit (FPC). The circuit board has a plurality of first conductive sections and a plurality of second conductive sections respectively formed thereon. The first conductive sections are electrically connected to the first electric conductive sections of the flat cable. The first conductive sections and the second conductive sections are electrically connected to each other via a displacement circuit disposed in the circuit board for providing a function as jumper(s). A first connector is electrically connected to the circuit board. A second connector is electrically connected to the second end of the flat cable. The flat cable has two opposite sides each having a protrusion laterally extending therefrom and the circuit board has two opposite ends respectively having a protrusion laterally extending therefrom. Each protrusion of the circuit board abuts a corresponding one of the two protrusions of the flat cable and is inserted into the first connector such that the protrusions of the flat cable and the circuit board are engaged to the first connector for connecting the flat cable and the circuit board to the first connector. An adhering layer is previously sandwiched between the flat cable and the circuit board for easily connected the flat cable and the circuit board to the first connector.

Further benefits and advantages of the present invention will become apparent after a careful reading of the detailed description with appropriate reference to the accompanying drawings.

DETAILED DESCRIPTION OF THE INVENTION

Figure 1:
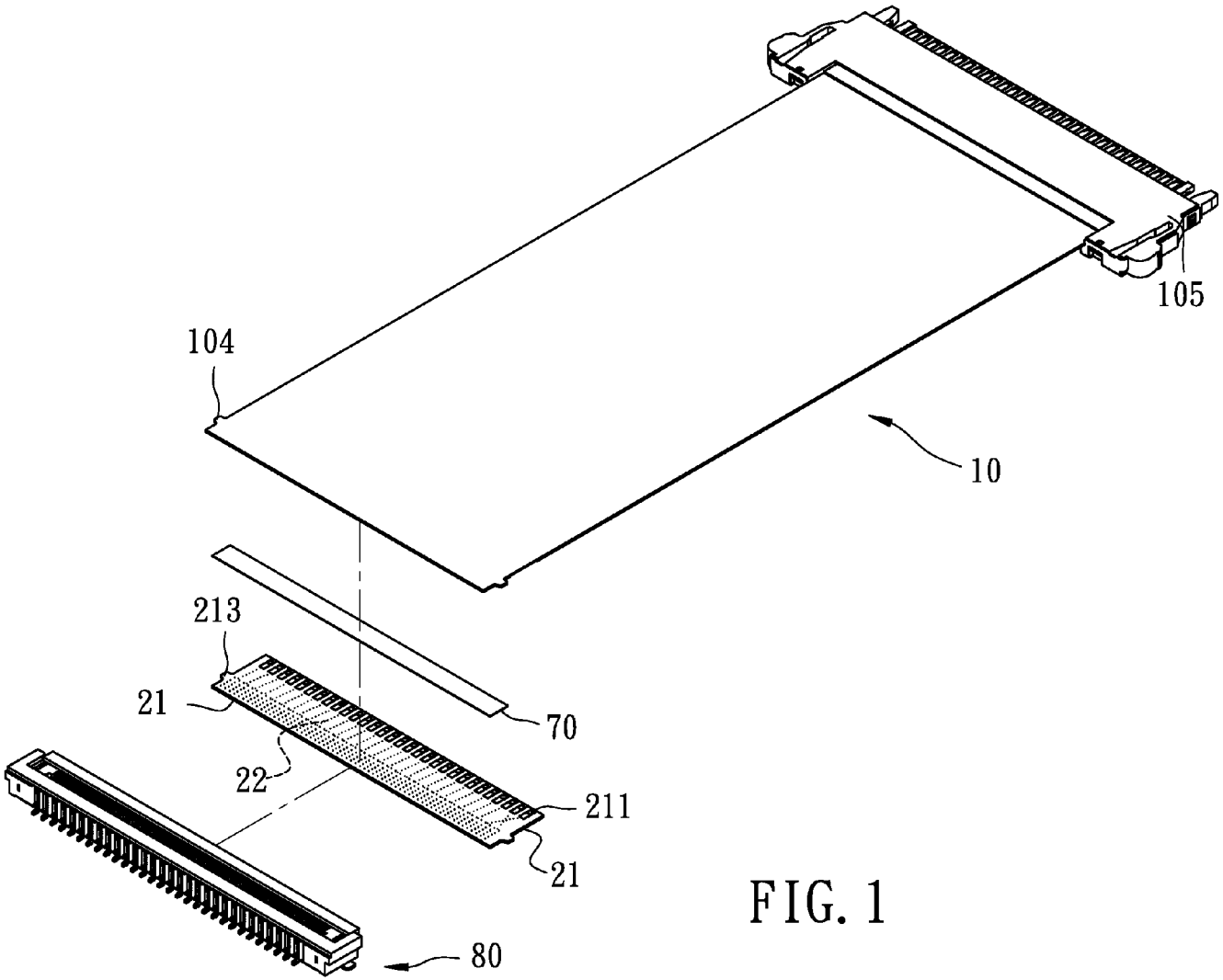
FIG. 1 is an exploded perspective view of a cable connector in accordance with the present invention.
Figure 2:
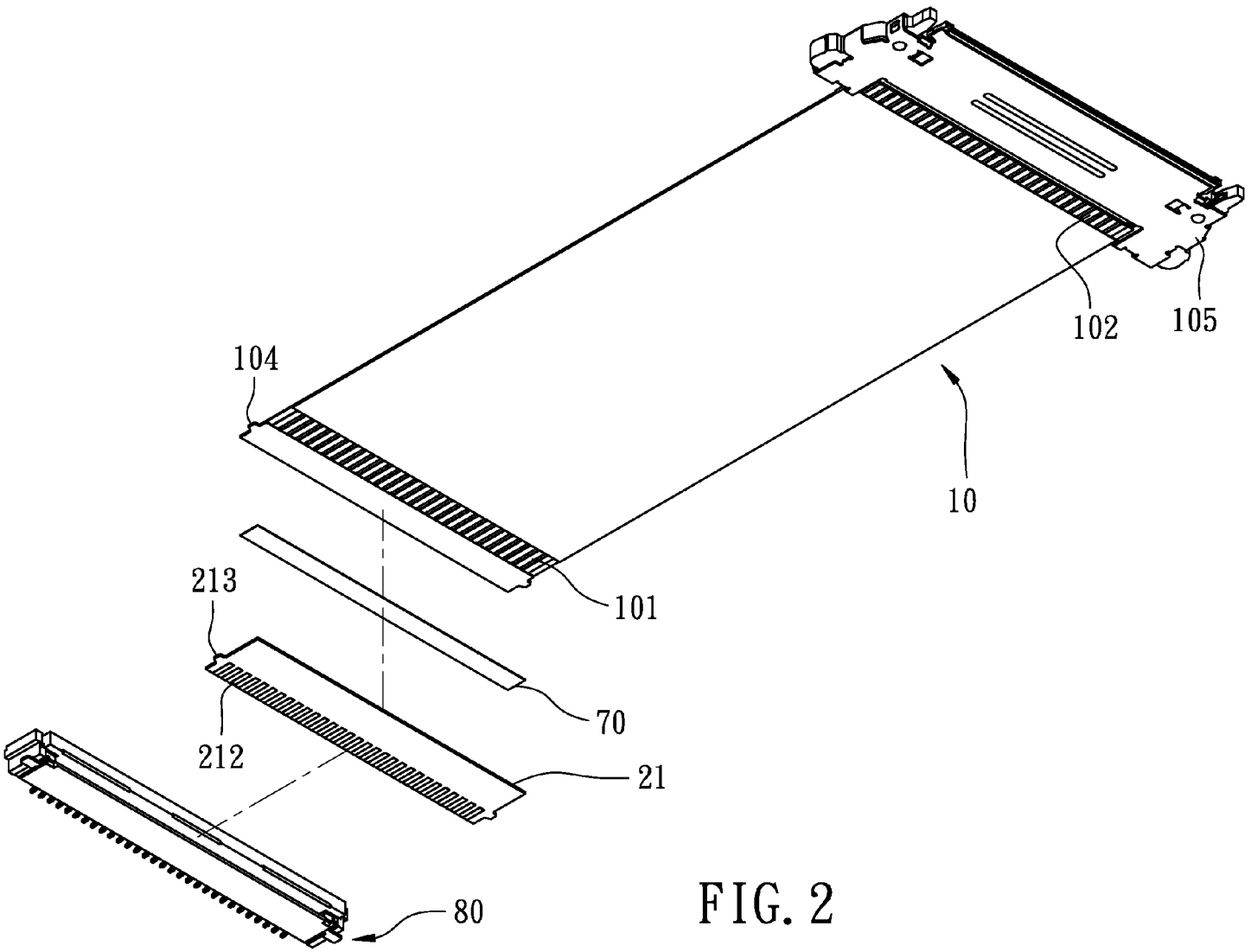
FIG. 2 is an exploded perspective view the cable connector of the present invention for showing the bottom of the elements.
Figure 3:
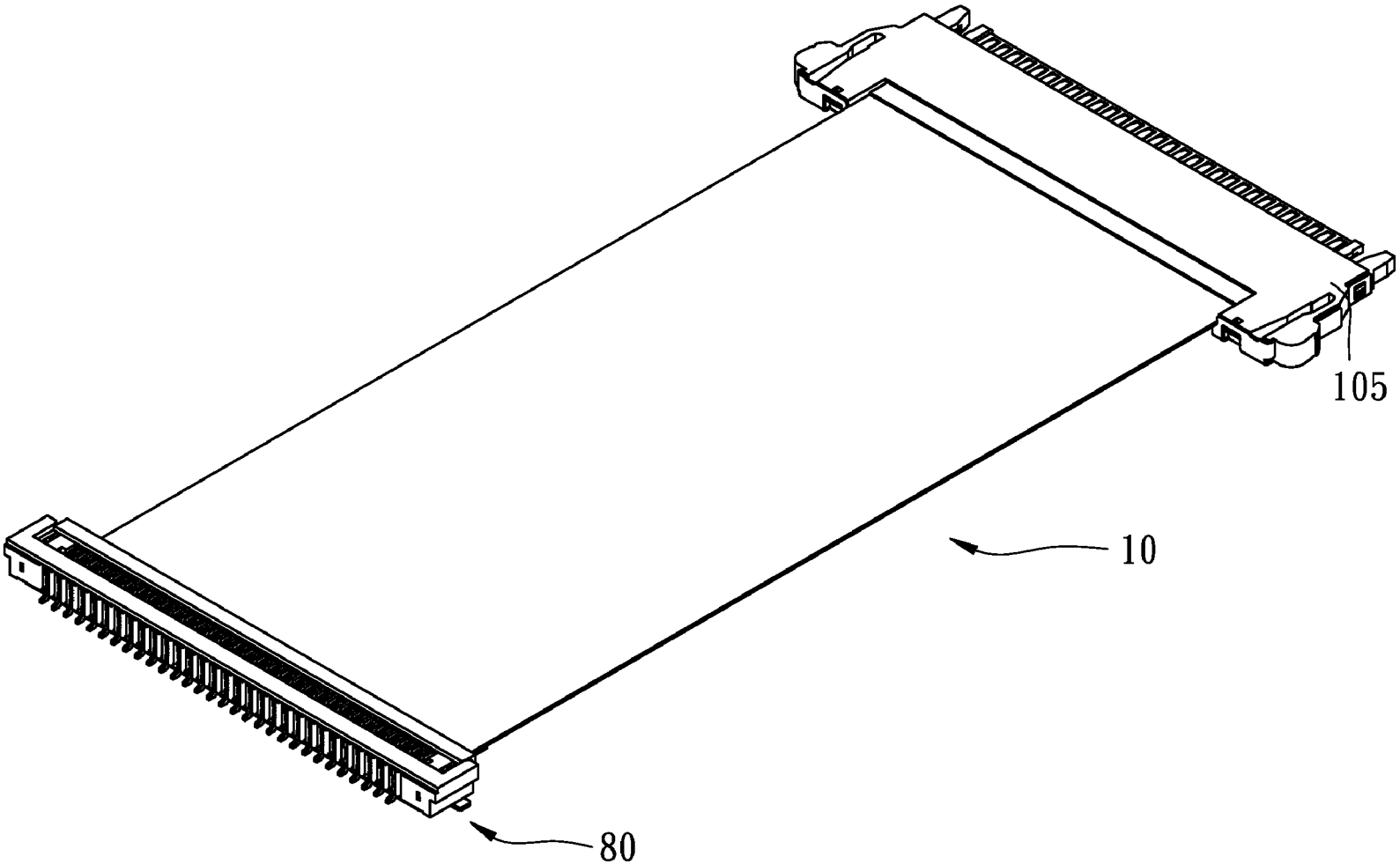
FIG. 3 is a perspective view of the cable connector in accordance with the present invention.

Referring to the drawings and initially to FIGS. 1-3, a cable connector in accordance with the present invention comprises a flat cable (10), a circuit board (21) electrically connected to the flat cable (10). In addition, the flat cable (10) and the circuit board (21) are connected to a first connector (80) after being connected to each other.

The flat cable (10) has a plurality of first electric conductive sections (101) formed on a first end thereof and a plurality of second electric conductive sections (102) formed on a second end thereof. In the preferred embodiment of the present invention, the flat cable (10) is a flexible flat cable (FFC). The first end of the flat cable (10) has two opposite sides each having a protrusion (104) laterally extending therefrom. A second connector (105) is electrically connected to a second end of the flat cable (10). The second connector (105) has a plurality of pins (not shown) connected to a plurality of second electric conductive sections (102) of the flat cable (10). In the preferred embodiment of the present invention, the second connector (105) is provided for low-voltage differential signaling (LVDS). Alternatively, the second connector (105) is an accessory insert board without pins connected to the flat cable (10).

A circuit board (21) is electrically connected to the first end of the flat cable (10). In the preferred embodiment of the present invention, the circuit board (21) is a flexible printed circuit (FPC). The circuit board (21) has a length shorter than that of the flat cable (10) for saving manufacturing cost. The circuit board (21) has a plurality of first conductive sections (211) and a plurality of second conductive sections (212) respectively disposed on two opposite sides thereof, wherein the first conductive sections (211) are electrically connected to the first electric conductive sections (101) of the flat cable (10) and the first conductive sections (211) and the second conductive sections (212) are electrically connected to each other. In addition, at least parts of the first conductive sections (211) and the second conductive sections (212) are electrically connected to each other not according to their corresponding positions via a displacement circuit (22) (dash line shown in FIG. 1) that is disposed in the circuit board (21). A layout design of the displacement circuit (22) can make parts of the first conductive sections (211) and the second conductive sections (212) sequentially connect to each other according to their corresponding positions and the others connect to each other not in sequence of their corresponding positions. Thus at least parts of the first conductive sections (211) and the second conductive sections (212) are not correspondingly connecting to each other in sequence according to their corresponding positions so as to provide a function as jumper(s). The circuit board (21) has two opposite ends respectively having a protrusion (213) laterally extending therefrom. The first connector (80) electrically connected to the circuit board (21). The first connector (80) has a plurality of pins (not shown) connected to the second conductive sections (212) of the circuit board (21). When assembling the flat cable (10) and the circuit board (21) to the first connector (80), each protrusion (213) of the circuit board (21) abuts a corresponding one of the two protrusions (104) of the flat cable (10) and is inserted into the first connector (80) such that the protrusions (104, 213) are engaged to the first connector (80) for connecting the flat cable (10) and the circuit board (21) to the first connector (80). Furthermore, an adhering layer (70) is previously sandwiched between the flat cable (10) and the circuit board (21) for easily connected the flat cable (10) and the circuit board (21) to the first connector (80). As a result, the second conductive section (212) is provided to connect with an extra electric interface.

Although the invention has been explained in relation to its preferred embodiment, it is to be understood that many other possible modifications and variations can be made without departing from the spirit and scope of the invention as hereinafter claimed.

What is claimed is:

1. A cable connector comprising:

a flat cable having a plurality of first electric conductive sections formed on a first end and a plurality of second electric conductive sections formed on a second end thereof, a circuit board electrically connected to the first end of the flat cable, the circuit board having a plurality of first conductive sections and a plurality of second conductive sections respectively formed thereon, the first conductive sections electrically connected to the first electric conductive sections of the flat cable, the first conductive sections and the second conductive sections electrically connected to each other via a displacement circuit disposed in the circuit board, wherein at least parts of the first conductive sections and the second conductive sections are not correspondingly connecting to each other in sequence according to their corresponding positions for providing a function as jumper(s); a first connector electrically connected to the circuit board, wherein a plurality of pins of the first connector is connected to the second conductive sections of the circuit board, and a second connector connected to the second end of the flat cable.

2. The cable connector as claimed in claim 1, wherein the second connector is electrically connected to the second electric conductive sections of the flat cable.

3. The cable connector as claimed in claim 1, wherein the circuit board is a flexible printed circuit (FPC).

4. The cable connector as claimed in claim 1, wherein the flat cable has two opposite sides each having a protrusion laterally extending therefrom and the circuit board has two opposite ends respectively having a protrusion laterally extending therefrom, each protrusion of the circuit board abutting a corresponding one of the two protrusions of the flat cable and inserted into the first connector such that the protrusions of the flat cable and the circuit board are engaged to the first connector for connecting the flat cable and the circuit board to the first connector.

5. The cable connector as claimed in claim 1, further comprising an adhering layer previously sandwiched between the flat cable and the circuit board for easily connecting the flat cable and the circuit board to the first connector.

* * * * *